US007857440B2

(12) United States Patent
Gold et al.

(10) Patent No.: US 7,857,440 B2
(45) Date of Patent: Dec. 28, 2010

(54) VISUAL IDENTIFICATION OF SOLID INK STICKS

(75) Inventors: Christopher Ryan Gold, Tigard, OR (US); Brent Rodney Jones, Sherwood, OR (US); William Loren Emery, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 419 days.

(21) Appl. No.: 12/016,862

(22) Filed: Jan. 18, 2008

(65) Prior Publication Data

US 2009/0185017 A1 Jul. 23, 2009

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS 6,857,732 B2 2/2005 Jones et al.
6,874,880 B2 4/2005 Jones
6,893,121 B2 5/2005 Jones
7,063,412 B2 6/2006 Jones et al.

*Primary Examiner*—Matthew Luu
*Assistant Examiner*—Rut Patel
(74) *Attorney, Agent, or Firm*—Maginot, Moore & Beck LLP

(57) ABSTRACT

An ink stick comprises an ink stick body configured for insertion in an insertion direction into an ink loader of the phase change ink imaging device. The ink stick body has an insertion perimeter in a plane substantially perpendicular to the insertion direction and has a longitudinal dimension for aligning with a feed direction of the ink loader. A symbol contour is formed in a first position on the perimeter of the ink stick body. The symbol contour defines a portion of a perimeter of a visually recognizable symbol shape and extends at most partially along the perimeter of the ink stick in the longitudinal dimension of the ink stick body. At least one key contour is formed in a second position on the perimeter of the ink stick body corresponding to a color of the ink for the ink stick body.

19 Claims, 8 Drawing Sheets

VISUAL IDENTIFICATION OF SOLID INK STICKS

TECHNICAL FIELD

This disclosure relates generally to phase change ink jet printers and, in particular, to the solid ink sticks used in such ink jet printers.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to a print head for jetting onto a recording medium.

One difficulty faced in solid ink technology is identification and authentication of ink sticks to ensure the correct loading and compatibility of an ink stick with the imaging device in which it is used. For example, unlike powdered or liquid marking materials, the solid form of ink sticks allows the ink sticks to be handled and loaded into a phase change ink printer without the need for a container or cartridge, as is typically required for liquid ink or powdered toner. In addition, the entire ink stick may be melted and consumed, with no need to dispose of, or recycle, any container. Eliminating the need for a container provides many advantages to the use of ink sticks. Containers or cartridges, however, may be provided with electronic tags, barcodes, etc. that may be used to identify and/or authenticate the ink contained therein. Without the use of a container, the mechanisms for authenticating or otherwise identifying the ink stick may be limited.

Provisions have been made to facilitate the authentication and/or identification of ink sticks so that ink sticks are correctly loaded into the intended feed channel and to ensure that the ink sticks are compatible with the printer with which they are used. One provision is generally directed toward excluding wrong colored or incompatible ink sticks from being inserted into the feed channels of the printer. For example, the correct loading of ink sticks has been accomplished by incorporating keying features into the exterior surface of an ink stick. These features are protuberances or indentations that are located in different positions on an ink stick. For example, FIG. 9 shows an embodiment of an ink stick 2 that includes a keying feature 4 that is in the form of a notch that extends along a side surface of the ink stick. Corresponding key elements 6 are positioned on the perimeter of the opening 8 through which the ink stick 2 is inserted. An ink stick that does not have the appropriate key elements in the correct position for the particular insertion opening is excluded from insertion.

To further aid a customer in identifying ink sticks, previously known ink sticks have incorporated visually recognizable symbols either into a surface of the ink stick or as the shape of the ink stick itself. The visually recognizable symbol is a shape that provides the printer operator with meaning that the operator can then use to associate the ink stick with a particular keyed opening or feed channel. The printer operator can correlate a visually recognizable symbol with a particular feed channel more easily than correlating a keyed shape that does not convey symbolic significance.

The previously known ink sticks that incorporated visually recognizable symbols, however, have generally been cube shaped or have had longitudinal dimensions that are not substantially different from the width dimension of the ink stick. Emerging phase change ink jet technologies have reduced the time for generating solid ink images, and, as a result, have a high ink consumption rate. As a consequence, larger capacity solid ink delivery systems have been devised. The increased capacity of solid ink delivery systems having non-linear feed channels has prompted the development and use of ink sticks having a larger length to width aspect ratio. The use of "longer" ink sticks lessens the frequency at which the solid ink in the ink delivery system has to be replenished. Ink sticks that are generally larger in size and, in particular, longer in longitudinal, or length, dimension of the ink stick, however, may make visually recognizable symbols that encompass most or all of a surface or perimeter shape of the ink stick unrecognizable.

SUMMARY

An ink stick for use in a phase change ink imaging device has been developed that addresses difficulties posed by the size and aspect ratio of ink sticks and allows symbol shapes to be incorporated by applying these shapes to less than the full stick size. Ink stick sets with unique symbol shapes are incorporated into an ink stick periphery form such that the shape aids a user in identifying the appropriate color channel for which the ink stick is intended but may or may not contribute to keying differentiation.

In one embodiment, the ink stick comprises an ink stick body configured for insertion in an insertion direction into an ink loader of a phase change ink imaging device and for feeding in the ink loader in a feed direction of the ink loader. The ink stick body has an insertion perimeter in a plane substantially perpendicular to the insertion direction and has a longitudinal dimension for aligning with the feed direction. A symbol contour is formed in a first position on the insertion perimeter of the ink stick body extending at least partially along the ink stick body in a direction substantially parallel to the insertion direction. The symbol contour defines a portion of a perimeter of a visually recognizable symbol shape. The symbol contour extends at most partially along the insertion perimeter of the ink stick in the longitudinal dimension of the ink stick body. At least one key contour is formed in a second position on the perimeter of the ink stick body extending at least partially along the ink stick body in a direction substantially parallel to the insertion direction. The at least one key contour corresponds to a color of the ink for the ink stick body.

In another embodiment, a set of ink sticks is provided. The set of ink sticks comprises a first, second, third and fourth ink stick each having a top surface, a bottom surface, and a plurality of side surfaces extending between the top and the bottom surfaces. The plurality of side surfaces define a perimeter of the ink stick that includes a leading perimeter segment, a trailing perimeter segment, and a pair of lateral perimeter segments extending between the leading and trailing perimeter segments. Each of the first, second, third and fourth ink sticks has a longitudinal axis extending between the leading and the trailing perimeter segments for aligning with a feed direction of an ink loader of a phase change ink imaging device. Each of the first, second, third and fourth ink sticks include a symbol contour formed in a symbol position on at least one of the lateral perimeter segments. The symbol contour defines a portion of a perimeter of a visually recognizable symbol shape as viewed in a direction substantially toward the top surface of the ink stick. The symbol contour extends from the top surface at least partially toward the bottom surface of the ink stick and extends at most partially along the at least one of the lateral perimeter segments in a direction parallel to the longitudinal axis of the ink stick. The first ink stick is of a first color and has a first symbol contour defining a portion of a perimeter of a first visually recognizable symbol shape. The second ink stick is of a second color having a second symbol contour defining a portion of a perimeter of a second visually recognizable symbol shape. The third ink stick is of a third color having a third symbol contour defining a portion of a perimeter of a third visually recognizable symbol shape. The fourth ink stick is of a fourth color having a fourth symbol contour defining a portion of a perimeter of a fourth visually recognizable symbol shape. Each of the first, second, third and fourth ink sticks includes at least one color key contour corresponding to the color of the ink stick. The at least one color key contour is formed on the perimeter of each ink stick extending from the top surface at least partially toward the bottom surface. A position of the at least one color key contour on the perimeter is different for each of the first, second, third and fourth ink sticks and different from the symbol position.

In yet another embodiment, an ink stick is provided. The ink stick comprises an ink stick body including a top surface, a bottom surface and a plurality of side surfaces extending between the top and the bottom surfaces. The plurality of side surfaces defines a perimeter of the ink stick body. The perimeter includes a leading perimeter segment, a trailing perimeter segment, and a pair of lateral perimeter segments extending between the leading and trailing perimeter segments. The ink stick body has a longitudinal axis extending between the leading and the trailing perimeter segments for aligning with a feed direction of an ink loader of a phase change ink imaging device. A symbol contour is formed in at least one of the pair of lateral perimeter segments in a first position along the longitudinal axis of the ink stick body. The symbol contour defines a portion of a perimeter of a visually recognizable symbol shape as viewed in a direction substantially toward the top surface of the ink stick body. The symbol contour extends from the top surface at least partially toward the bottom surface of the ink stick body and extends at most partially along the longitudinal axis of the ink stick body. At least one key contour is formed in at least one of the leading, the trailing and the pair of lateral perimeter segments in at least one other position on the perimeter of the ink stick body extending from the top surface at least partially toward the bottom surface.

BRIEF DESCRIPTION OF THE DRAWINGS

FIG. 9 depicts a prior art ink stick and a corresponding insertion opening of an ink loader.

DETAILED DESCRIPTION OF THE PREFERRED EMBODIMENT

Figure 1:
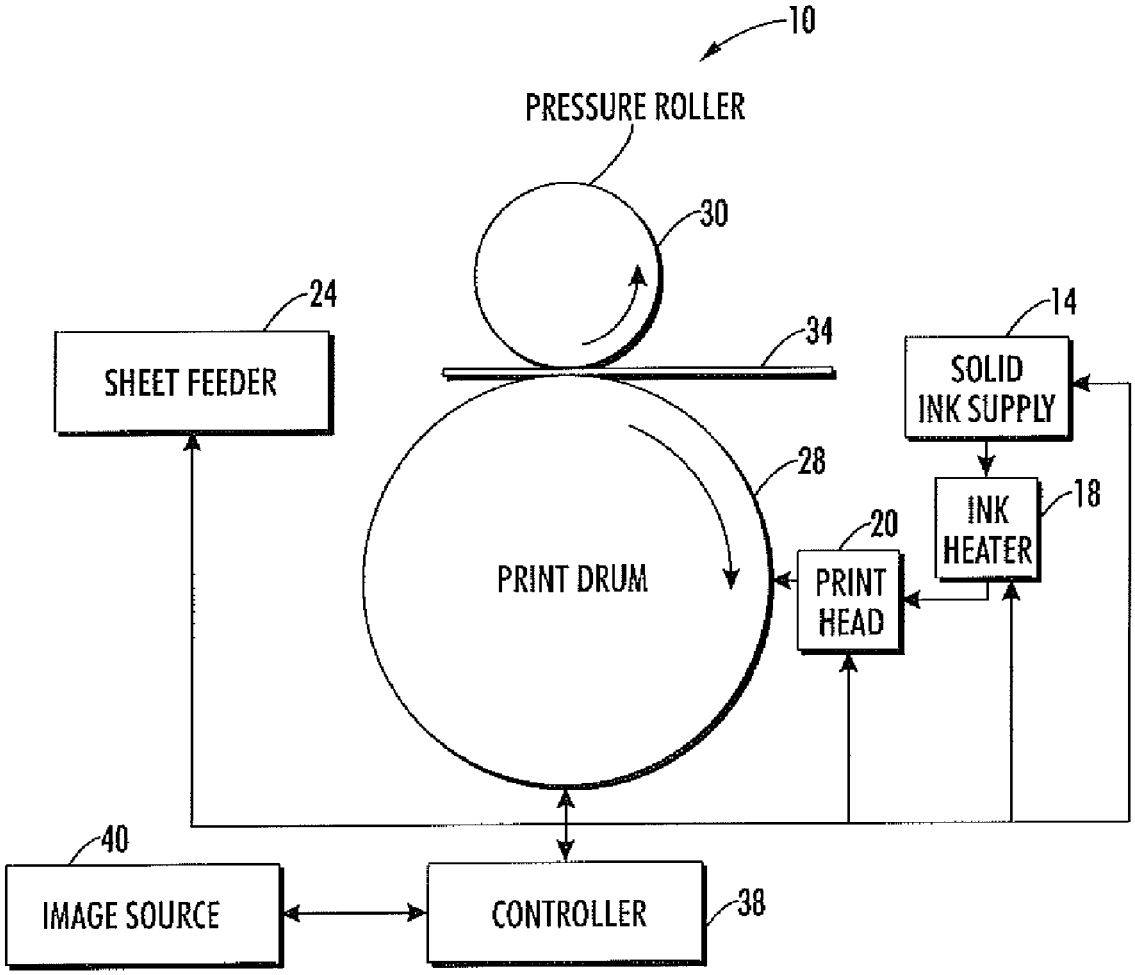
FIG. 1 PRIOR ART
FIG. 1 is a block diagram of a phase change ink imaging device.

For a general understanding of the present embodiments, reference is made to the drawings. In the drawings, like reference numerals have been used throughout to designate like elements. As used herein, the term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a printhead are intended to encompass the range of melters, intermediate connections, tubes, manifolds and/or other components and/or functions that may be involved in a printing system but are not immediately significant to the present invention.

Referring now to FIG. 1, there is illustrated a block diagram of an embodiment of a phase change ink imaging device 10. The imaging device 10 has an ink supply 14 which receives and stages solid ink sticks. An ink melt unit 18 heats the ink stick above its melting point to produce liquefied ink. The melted ink is supplied to a printhead assembly 20 by gravity, pump action, or both. The imaging device 10 may be a direct printing device or an offset printing device. In a direct printing device, the ink may be emitted by the print head 20 directly onto the surface of a recording medium.

The embodiment of FIG. 1 shows an indirect, or offset, printing device. In offset printers, the ink is emitted onto a transfer surface 28 that is shown in the form of a drum, but could be in the form of a supported endless belt. To facilitate the image transfer process, a pressure roller 30 presses the media 34 against the ink on the drum 28 to transfer the ink from the drum 28 to the media 34.

Operation and control of the various subsystems, components and functions of the machine or printer 10 are performed with the aid of a controller 38. The controller 38, for example, may be a micro-controller having a central processor unit (CPU), electronic storage, and a display or user interface (UI). The controller reads, captures, prepares and manages the image data flow between image sources 40, such as a scanner or computer, and imaging systems, such as the printhead assembly 20. The controller 38 is the main multitasking processor for operating and controlling all of the other machine subsystems and functions, including the machine's printing operations, and, thus, includes the necessary hardware, software, etc. for controlling these various systems.

Figure 2:
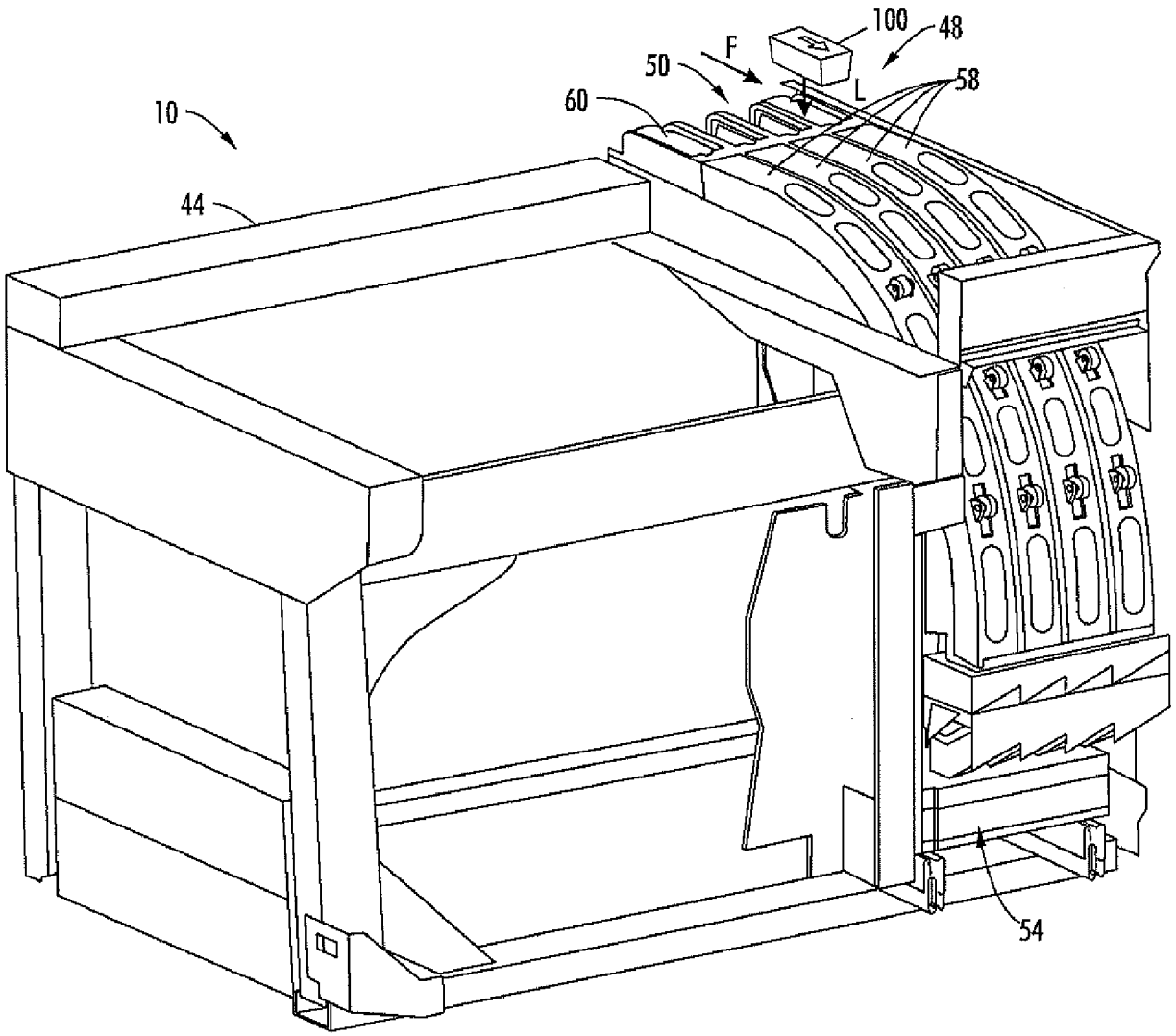
FIG. 2 is an enlarged partial top perspective view of an embodiment of an incomplete phase change ink imaging device with an ink loader.

Referring now to FIG. 2, the device 10 includes a frame 44 to which the operating systems and components are directly or indirectly mounted. A solid ink delivery system 48 advances ink sticks from loading station 50 to a melting station 54. The melting station 54 is configured to melt the solid ink sticks and supply the liquid ink to a printhead system (not shown). All forms of solid ink are referred to as ink sticks or simply ink or sticks. The ink delivery system 48 includes a plurality of channels, or chutes, 58. A separate channel 58 is utilized for each of the four colors: namely cyan, magenta, black and yellow.

The loading station includes keyed openings 60. Each keyed opening 60 limits access to one of the individual feed channels 58 of the ink delivery system. The keyed openings 60 are configured to accept only those ink sticks having key elements that comport with the key structures of the openings 60. Thus, the keyed openings 60 help limit the ink sticks inserted into a channel to a particular configuration such as color, ink formulation, etc.

To better utilize the space within the imaging device 10, the feed channels 58 may have any suitable path for delivering ink sticks from the loading station 50 to the melt station 54. For example, the feed channels 58 may have linear and curved sections as needed to provide space for other components and to still deliver ink sticks from the loading station 50 to the melting station 54. An arcuate portion of the feed path may be short or may be a substantial portion of the path length. The full length of the chute may be arcuate and may consist of different or variable radii. A linear portion of the feed path may likewise be short or a substantial portion of the path length.

The depicted solid ink delivery system 48 includes a drive member (not shown) for moving one or more ink sticks 68 along the feed path in the respective feed channel 58. A separate drive member may be provided for each respective feed channel. The feed channel 58 for each ink color retains and guides ink so that the ink progresses along a desired feed path. The drive member, if utilized, may have any suitable size and shape. The drive member may be used to transport the ink over all or a portion of the feed path and may provide support or guidance to the ink and may be the primary ink guide over all or a portion of the feed path.

Figure 3:
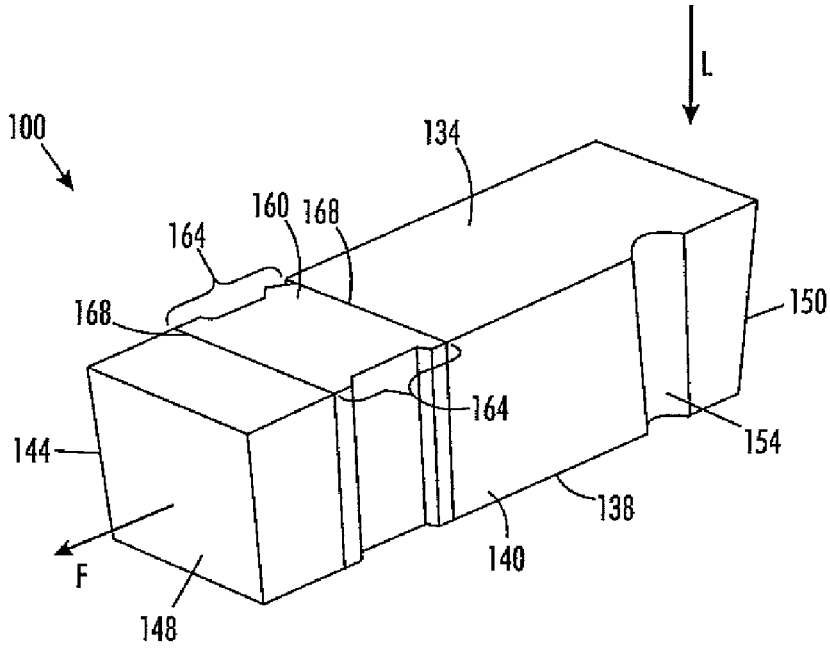
FIG. 3 is a perspective view of one embodiment of a solid ink stick with a visually recognizable symbol incorporated partially into the perimeter of the ink stick.

An ink stick may take many forms. One exemplary solid ink stick 100 for use in the ink delivery system is illustrated in FIG. 3. The ink stick has a bottom surface 138 and a top surface 134. The particular bottom surface 138 and top surface 134 illustrated are substantially parallel one another, although they can take on other contours and relative relationships. Moreover, the surfaces of the ink stick body need not be flat, nor need they be parallel or perpendicular one another. The ink stick body also has a plurality of side extremities, such as lateral side surfaces 140, 144 and end surfaces 148, 150. The side surfaces 140 and 144 are substantially parallel one another, and are substantially perpendicular to the top and bottom surfaces 134, 138. The end surfaces 148, 150 are also basically substantially parallel one another, and substantially perpendicular to the top and bottom surfaces, and to the lateral side surfaces. One of the end surfaces 148 is a leading end surface, and the other end surface 150 is a trailing end surface. The ink stick body may be formed by pour molding, injection molding, compression molding, or other known techniques.

Due to the high ink consumption rates that are possible with phase change ink imaging devices, the ink stick 100 may have an aspect ratio in which the longitudinal length of the ink stick body between the leading end 148 and the trailing end 150 is significantly greater than the width and/or height of the ink stick body between the lateral side surfaces 140 and the height of the ink stick body between the top surface and the bottom surface. The use of "longer" ink sticks lessens the frequency at which the solid ink in the ink delivery system has to be replenished. The longitudinal length of the ink stick body is typically the dimension that is substantially aligned with the feed direction of a feed channel. The width and height of the ink stick are perpendicular to the length. The ratio of the length of the ink stick body to the width and/or height may depend on a number of factors such as aesthetics, fabrication, loader orientation and/or functional requirements. For example, in one embodiment, the ink stick has an aspect ratio in which the length of the ink stick is at least approximately 1.5 times the width of the ink stick although the ink stick may have any suitable aspect ratio.

The ink stick body has an outer perimeter that is substantially horizontal around the largest horizontal cross section of the ink stick body. In the ink stick embodiment illustrated in FIG. 3 in which the side surfaces are substantially vertical, the outer perimeter is substantially uniform from the bottom surface to the top surface of the ink stick body. In the ink stick embodiment of FIG. 3, the horizontal outer perimeter substantially corresponds with the top surface 134 of the ink stick body. The outermost lateral side portions 140 and 144 of the ink stick body form longitudinal ink stick body perimeter segments that extend substantially parallel with the longitudinal feed direction F of the feed channel when the ink stick is inserted into the feed channel. After considering the present disclosure, those skilled in the art will recognize that the outermost segments of the perimeter can be in different positions along the height of the ink stick body. The perimeter longitudinal segment on one of the lateral side surfaces can even be at a different height than the perimeter longitudinal segment on the other lateral side surface.

Ink sticks may include a number of features that aid in correct loading, guidance, sensing and support of the ink stick when used. These loading features may comprise protrusions and/or indentations that are located in different positions on an ink stick for interacting with key elements, guides, supports, sensors, etc. located in complementary positions in the ink delivery system. Loading features may be categorized as insertion features or feeding features. Insertion features such as exclusionary keying elements and orientation elements are configured to facilitate correct insertion of ink sticks into the loading station and, as such, are substantially aligned with the insertion direction L of the loading station. As an example, the ink stick of FIG. 3 includes an insertion keying feature 154. The insertion keying feature is configured to interact with the keyed openings 60 of the loading station 50 (FIG. 2) to admit or block insertion of the ink sticks through the insertion opening 60 of the solid ink delivery system. In the ink stick embodiment of FIG. 3, the key element 154 is a vertical recess or notch formed in side surface 140 of the ink stick body substantially parallel to the insertion direction L of the loading station. The corresponding complementary key (not shown) on the perimeter of the keyed opening 60 is a complementary protrusion into the opening 60.

Although not depicted, the ink stick may include feeding features, such as alignment and guide elements, to aid in aligning and guiding ink sticks as they are moved along the feed channels to reduce the possibility of ink stick jams in the feed channel and to promote optimum engagement of the ink sticks with an ink melter in the ink melt assembly. Feeding features, therefore, may be substantially aligned with the feed direction F of the ink delivery system in order to interact with ink stick guides and/or supports in the ink delivery system. An ink stick may have any suitable number and/or placement of loading (i.e. insertion and/or feeding) features.

Each color for a printer may have a unique arrangement of one or more key elements in the outer perimeter of the ink stick to form a unique cross-sectional shape for that particular color ink stick. The combination of the keyed openings in the key plate and the keyed shapes of the ink sticks insure that only ink sticks of the proper color are inserted into each feed channel. A set of ink sticks is formed of an ink stick of each color, with a unique key feature arrangement for ink sticks of each color. Insertion keying may also be used to differentiate ink sticks intended for different models of printers. One type of insertion key may be placed in all the keyed openings of feed channels of a particular model printer. Ink sticks intended for that model printer contain a corresponding insertion key element. An insertion key of a different size, shape, or position may be placed in the keyed openings of the feed channels of different model printers.

To address the need to provide printer operators with a functional recognition feature incorporated into an ink stick having a high length-to-width aspect ratio, such as the exemplary ink stick of FIG. 3, a portion of the perimeter of the ink stick is contoured to define a portion of a visually recognizable symbol shape 160. A visually recognizable symbol is a shape such as an alphanumeric character that provides the printer operator with meaning that the operator may then use to associate the ink stick with a particular keyed opening or feed channel. The symbol shape may be incorporated into one or both sides. The size, angle, and form of the symbol may be varied to accommodate the size and shape of the stick and to address aesthetic issues. The symbol form may be inset or protruding from the side or sides incorporating the shape and may be inset or protruding from the top surface. The printer operator may correlate a visually recognizable symbol with a particular feed channel more easily than correlating a keyed shape that does not convey symbolic significance. For example, a printer operator may correlate the symbol incorporated into the ink stick with the corresponding keyed opening in the key plate of the ink loader, or by correlating the symbol of the ink stick with the corresponding symbol that can be displayed adjacent the keyed opening.

A visually recognizable symbol shape may be incorporated partially into the perimeter of an ink stick by providing symbol contours 164 that define a portion of the shape of the visually recognizable symbol 160 in predetermined locations on the perimeter of the ink stick. In one embodiment, symbol contours may be provided on one or more of the lateral perimeter segments (side surfaces 140, 144) of the ink stick. The symbol contours 164 extend from the top surface of the ink stick at least partially along the side surfaces toward the bottom surface. Because the side surfaces 140, 144 of the ink stick of FIG. 3 are substantially parallel to each other and perpendicular to the top surface 134, the symbol contours extend substantially uniformly from the top surface to the bottom surface. The side surfaces of the ink stick body may also be sloped, segmented, or stepped so that the lower portion of the ink stick body is narrower than the upper portion in which case symbol contours may only extend partially toward the bottom surface. Other configurations are possible in which the side surfaces of the ink stick body are shaped so that the outer perimeter of the ink stick body is at a different elevation along the vertical height of the ink stick body or in which different segments of the outer perimeter are at different elevations along the vertical height of the ink stick body.

The ink stick of FIG. 3 includes symbol contours 164 that each define opposing portions of the perimeter of the visually recognizable numeric symbol "1." In particular, the symbol contour formed in the left lateral perimeter segment (formed by the left lateral side surface 144, as viewed from above the ink stick) forms the left side of the visually recognizable symbol, and the symbol contour formed in the right lateral perimeter segment (formed by the right lateral side surface 140) forms the right side of the visually recognizable symbol. Although the symbol contours 164 are shown substantially directly opposite from each other on the respective perimeter segments, the opposing symbol contours may be offset from each other so long as the contours are consistent with the desired shape of the visually recognizable symbol. The symbol contour on one of the sides may be utilized exclusively for visual recognition while the opposing symbol contour may additionally be used for keying (key contour), particularly color keying.

To further enhance visibility, the visual recognition of the symbol may be enhanced by providing an outline 168 of the remaining portion of the perimeter of the visually recognizable symbol shape in the top surface of the ink stick. For example, a line, groove, step, notch, bevel, inset, protrusion or other contrasting feature may be incorporated into the top surface of the ink stick to define the remaining portion of the perimeter of the visually recognizable symbol shape. The visually recognizable symbol may also be formed with a vertical dimension, so that it is seen as three dimensional to the user. Any suitable method or device may be used to impart the remaining portion of the perimeter of the symbol shape to the top surface. For example, the visual recognition of the symbol may be enhanced by embossing, debossing, or otherwise texturing the top surface of the ink stick body. As an alternative to embossing or debossing, the remaining portions of the symbol shape may be stamped, silk-screened, painted, etched, laser marked, or otherwise formed on an ink stick in any suitable manner. In alternative embodiments, however, the remaining perimeter portion of the symbol may be omitted from the top surface.

In the embodiment of FIG. 3, the symbol contours extend at most partially along the length (in the longitudinal dimension of the ink stick) of the respective side surfaces. By providing symbol contours that extend only partially along the length of the ink stick, the visually recognizable symbol may be incorporated into the ink stick at an aspect ratio that facilitates identification of the symbol. In addition, by providing symbol contours on portions of the perimeter of the ink stick that do not encompass entire sides of the ink stick or all or most of the perimeter of the ink stick, the benefits of visual identification and feed channel correlation may be retained while allowing much of the perimeter of the ink stick to be used for other non-symbolic features such as key elements, orientation features, etc. For example, as depicted in FIG. 3, the remaining portions of the lateral perimeter segments that do not have the symbol contours as well as the leading and trailing perimeter segments are available for the incorporation of non-symbolic key elements. As used herein, non-symbolic features such as key element contours do not contribute to forming the perimeter of a visually recognizable symbol shape.

Figure 4:
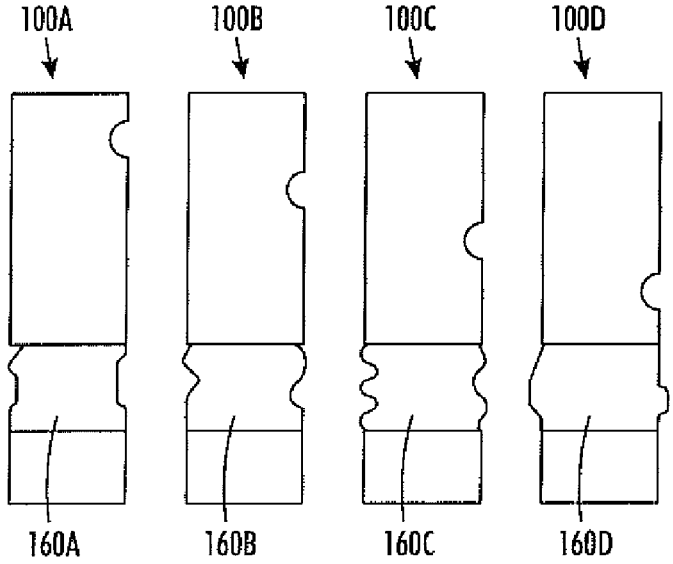
FIG. 4 is a top view of a set of ink sticks that includes the ink stick of FIG. 3, each ink stick including a visually recognizable symbol in the form of consecutive numerals.
Figure 5:
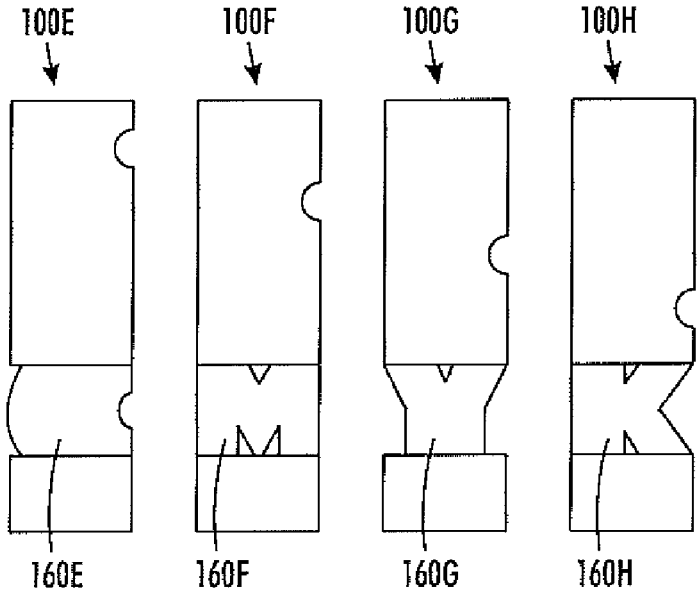
FIG. 5 is a top view of a set of ink sticks in which each ink stick includes a visually recognizable symbol in the form of a letter designating the color of the ink stick.

Each ink stick in a set of ink sticks (for example, yellow, cyan, magenta, black) may be formed with a different visually recognizable symbol. Each color corresponds to one of the feed channels of the ink loader. FIG. 4 shows a set of ink sticks 100A, 100B, 100C, 100D in which each ink stick in the set, or each color of ink stick, has a visually recognizable symbol 160A, 160B, 160C, 160D in the form of consecutive numerals, i.e. "1," "2," "3," and "4."

Figure 8:
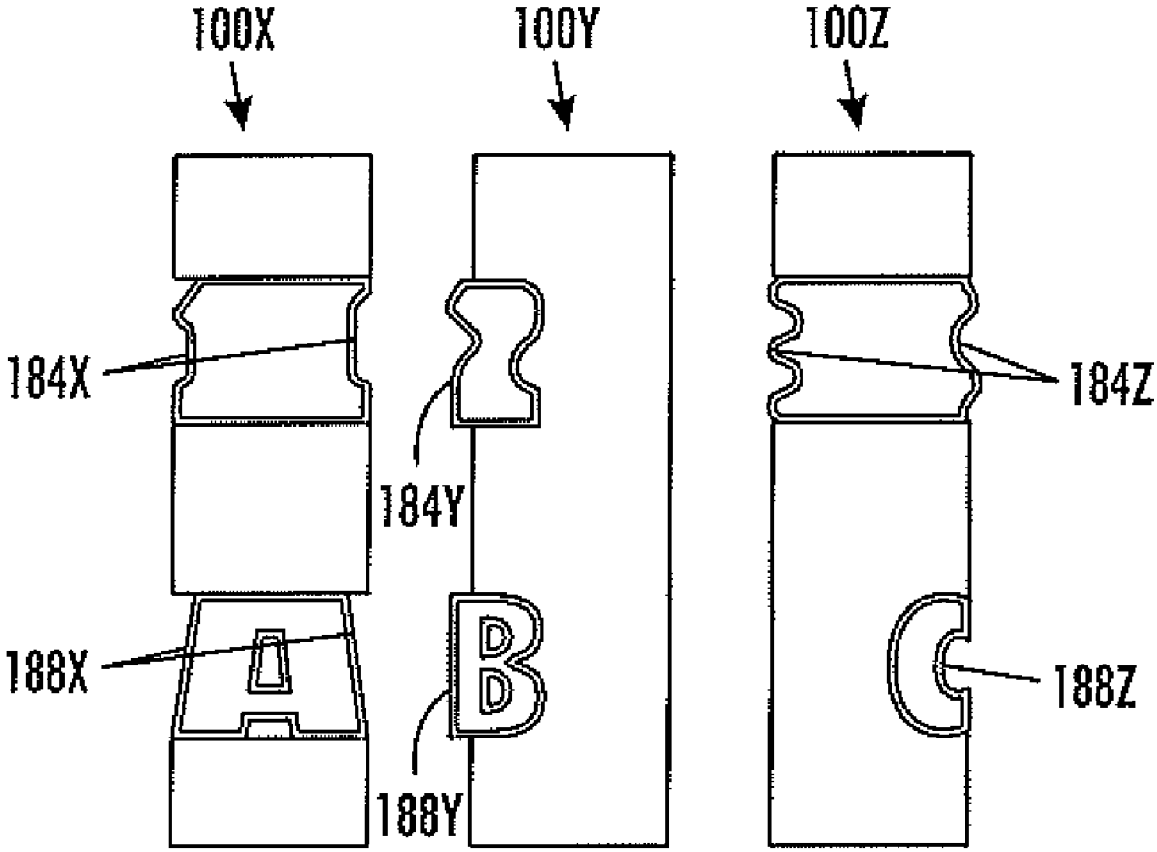
FIG. 8 is a top view of a plurality of ink sticks that each include multiple visually recognizable symbols.

Any visually recognizable symbol shape may be used that is capable of providing a printer operator with meaning that the operator may then use to associate the ink stick with a particular, product, keyed opening or feed channel. For example, the visually recognizable symbol 80 may be a letter indicating the color of the ink stick (i.e., "C" for cyan, "M" for magenta, "Y" for yellow, and "K" for black). Referring to FIG. 8, a set of ink sticks 100E, 100F, 10G, 100H has symbol contours that from visually recognizable alphabetical characters 160E, 160F, 160G, 160H. In the particular set shown, the alphabetical characters are "C," "Y," "M," and "K," which printer operators will associate with the colors of the ink—C for cyan, Y for yellow, M for magenta, and K for black. Symbol contours may also provide model or color keying functions and may do so to augment other key features or be utilized exclusive of additional features. A set of sticks may have a common symbol contour configuration, "A" as example, to differentiate the use of those sticks in a given product model while non-symbolic color keying features are provided independently. In this case, a second set of sticks for a different model may employ the same non-symbolic color keying features but have a different symbol shape, "B" as example.

Figure 6:
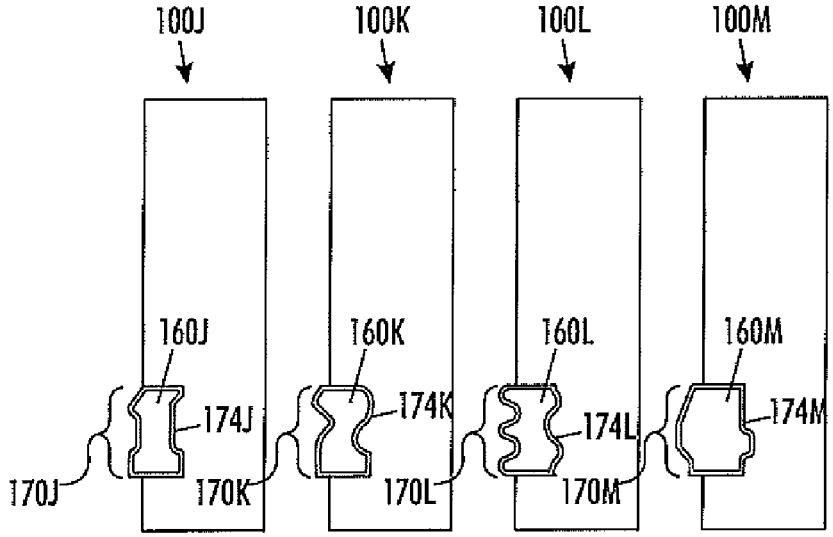
FIG. 6 is a top view of a set of ink sticks in which a symbol contour defining a portion of the perimeter of the visually recognizable symbol shape is formed on only one side of the ink stick.

As an alternative to using symbol contours 164 on opposing sides of the ink stick body to define opposing portions of the perimeter of a visually recognizable symbol 160, a symbol contour may be formed in one side of the ink stick. Symbol contours may be formed in either side of the ink stick. For example, FIG. 6 shows a set of ink sticks 100J, 100K, 100L, 100M in which a symbol contour 170J, 170K, 170L, 170M defining a portion of the perimeter of a visually recognizable symbol 160J, 160K, 160L, 160M is formed in the left lateral perimeter segment. Similar to FIG. 4, each ink stick has a visually recognizable symbol in the form of consecutive numerals, i.e. "1," "2," "3," and "4." An outline of the remaining portion 174J, 174K, 174L, 174M of the perimeter of the visually recognizable symbol shape may be formed in the top surface of the ink stick to enhance the recognition of the symbols.

Figure 7:
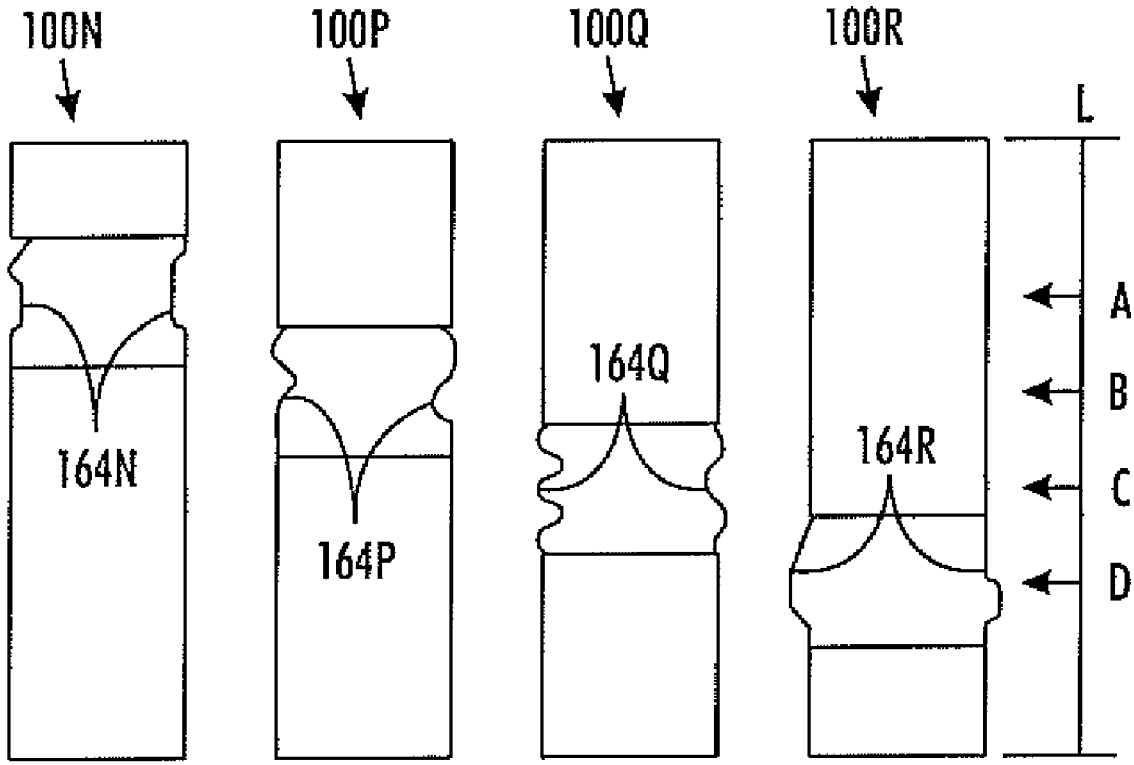
FIG. 7 is a top view of a set of ink sticks in which the visually recognizable symbol is formed at different positions along the longitudinal dimension of the ink stick.

Symbol contours defining portions of visually recognizable symbol shapes may be positioned at substantially any location along a side surface of the ink stick. For example, FIG. 7 shows a set of ink sticks in which symbol contours 164 defining a portion of the perimeter of a visually recognizable symbol shape 160 is formed at different positions along the longitudinal axis or length dimension L of the ink stick. Ink stick 100N includes a symbol contour 164N in a position on the lateral perimeter segments corresponding to a first position A along the longitudinal axis L of the ink stick. Similarly, ink sticks 100P, 100Q and 100R each include a symbol contour 164P, 164Q, 164R in a position on the lateral perimeter segments corresponding to second B, third C and fourth D positions along the longitudinal axis L. The position of symbol contours along the longitudinal axis of the ink stick may be used to further differentiate between the colors of ink sticks in a set of ink sticks, or, alternatively, may be used to differentiate between ink sticks intended for different printing platforms. For example, a set of ink sticks intended for a first printer model may include visually recognizable symbols in the first position along the longitudinal axis of the ink stick while a set of ink sticks intended for a second printer model may include visually recognizable symbols in the second position along the longitudinal axis of the ink stick.

More than one visually recognizable symbol may be incorporated into an ink stick using multiple symbol contours placed on one or more surfaces of a stick. The multiple visually recognizable symbols incorporated into a single ink stick may be the same or different. This approach allows a vastly extended range of symbol shape variations enabling an extensive array of differentiation. As an example, the visually recognizable symbols 1A, 1B, 1C . . . ; 2A, 2B, 2C; etc., may be used to differentiate ink sticks. FIG. 8 shows embodiments of ink sticks 100X, 100Y, 100Z, each including multiple symbol contours on different surfaces or different sections of a surface of the respective ink sticks to form portions of the perimeter of multiple visually recognizable symbols in each ink stick. For example, the ink stick 100X includes symbol contours 184X that form opposing portions of the perimeter of the visually recognizable symbol "1" in a first position along the longitudinal axis L and symbol contours 188X that form opposing portions of the perimeter of the visually recognizable symbol "A" in a second position along the longitudinal axis L. Similarly, the symbol contour 184Y of ink stick 100Y forms a portion of the perimeter of the visually recognizable symbol "2" and the symbol contour 188Y forms a portion of the perimeter of the symbol "B." Ink stick 100Z includes symbol contours 184Z and 188Z that form portions of the perimeter of the visually recognizable symbols "3" and "C," respectively.

Figure 9:
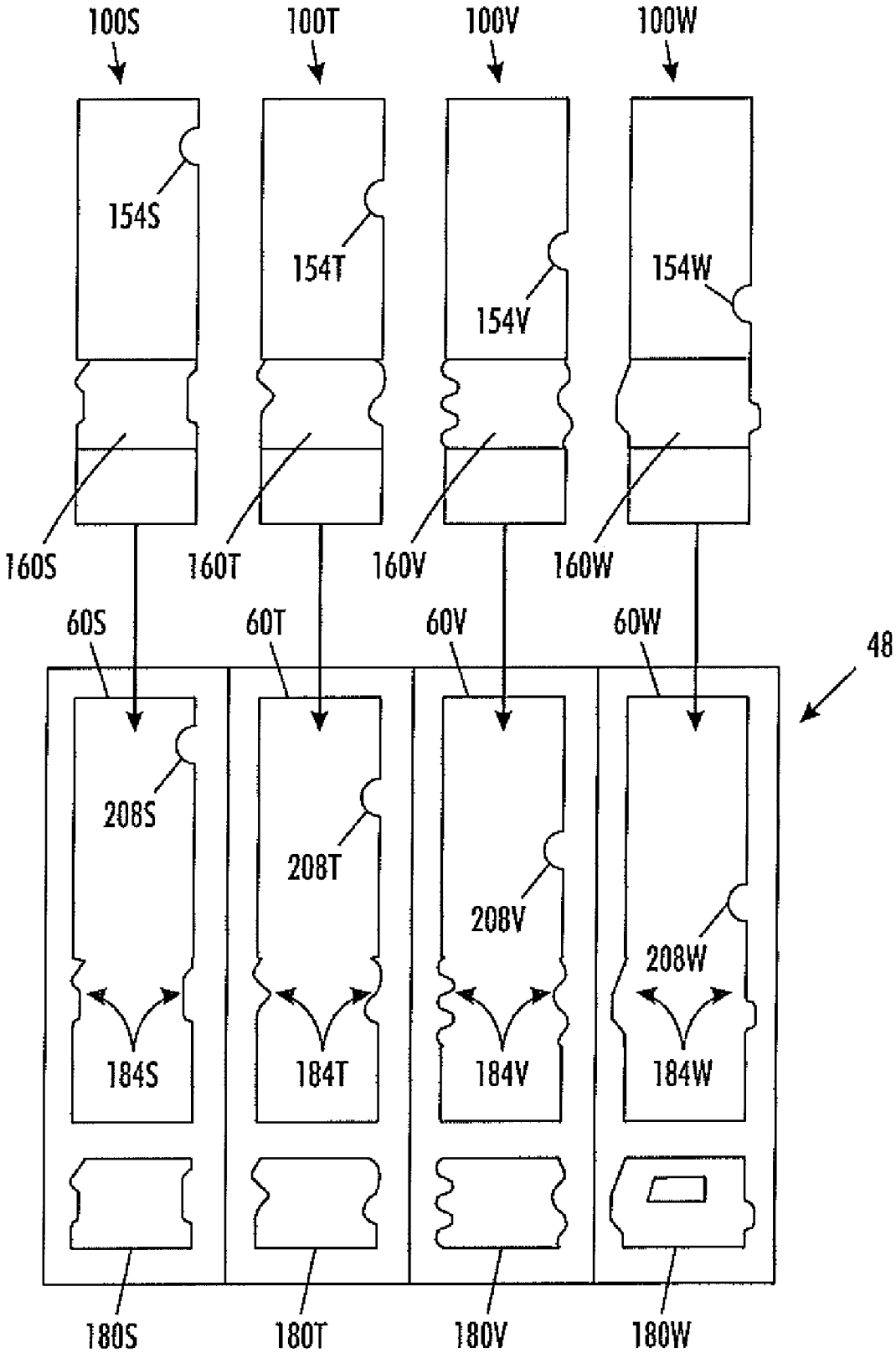
FIG. 9 shows an embodiment of the insertion station of an imaging device that includes complementary visually recognizable symbols adjacent the insertion openings.
Figure 10:
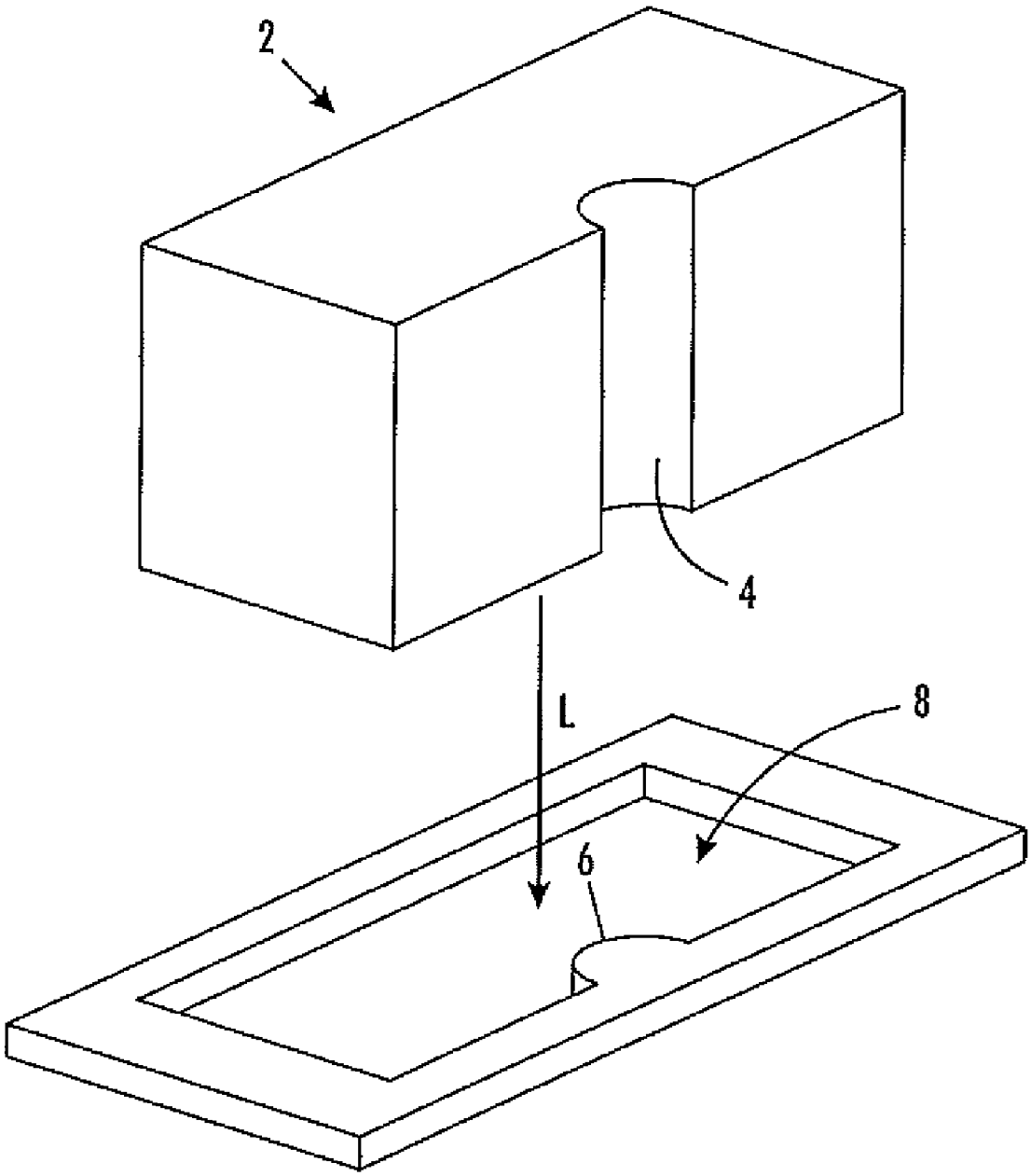
FIG. 10 PRIOR ART

To further aid a printer operator in associating an ink stick with a particular, product, keyed opening or feed channel, the visually recognizable symbol shape may be applied to or formed in the housing adjacent the keyed opening. This visually recognizable symbol aids the printer user in identifying particular keyed openings and their corresponding feed channels. For example, FIG. 9 shows an embodiment of an insertion station 48 that includes symbols 180 for further aiding a user in associating an ink stick with a particular keyed opening or feed channel. In the embodiment of FIG. 9, there is shown four ink stick 100S, 100T, 100V and 100W that are configured for insertion into the insertion openings 60S, 60T, 60V and 60W of the insertion station 48. As shown, the ink sticks 100 each include an insertion keying element 154 that is positioned on the ink stick to correspond to the insertion key 208 of the openings 60. The ink sticks each include a different visually recognizable symbol 160 comprising consecutive numerals such as the set of ink sticks shown in FIGS. 4 and 6. To further aid in ensuring that the ink sticks are inserted through the correct insertion opening, the insertion station 48 includes complementary symbols 180 positioned adjacent each opening 60. The complementary symbols may be any suitable mark, symbol, etc. that is capable of conveying meaning to a printer operator. Thus, a printer operator may associate an ink stick with a particular opening or feed channel of the printer, either by correlating the symbol of the ink stick with the corresponding keyed opening in the key plate, or by correlating the symbol of the ink stick with the corresponding symbol displayed adjacent the keyed opening.

Although not necessarily, the symbol contours formed in the ink sticks may be incorporated into the keyed openings 60 of the loading stations to provide keying mechanisms for differentiating ink sticks. For example, the keyed openings of the loading station each include complementary symbol contours 184 formed in complementary positions in the perimeter of the openings 60. As suggested in FIG. 9, the symbol contours may be used for keying and thus are key contours and they may be inset, protruding or a combination relative to the general periphery of the ink stick. In alternative embodiments, however, the symbol contours on the ink sticks and/or the openings 60 may be provided so the symbol contours of an ink stick minimally contributes to keying differentiation or do not contribute at all. For example, symbol contours may be provided that are inset into the side surfaces of the ink stick or that protrude minimally from the side surfaces so that the corresponding insertion opening areas do not have to be complementarily shaped.

Those skilled in the art will recognize that corners and edges may have radii or other non-sharp configurations, depending on various factors, including manufacturing considerations. The above description of ink sticks demonstrates that the particular individual features described above and shown in the various implementations illustrated can be combined in a wide variety of combinations and arrangements to meet the particular needs of particular environments. The above descriptions of the various embodiments and the accompanying figures illustrate particular implementations of the ideas and concepts embodied. After studying the above descriptions and accompanying figures, those skilled in the art will recognize a number of modifications can be made. For example, a variety of shapes are possible for the various key elements, the visually recognizable shapes, and the core ink stick body itself. Therefore, the following claims are not to be limited to the specific implementations described and illustrated above.

What is claimed is:

1. An ink stick formed of a phase change ink material, the ink stick comprising:

an ink stick body configured for insertion in an insertion direction into an ink loader of a phase change ink imaging device and for feeding in the ink loader in a feed direction, the ink stick body having an insertion perimeter in a plane substantially perpendicular to the insertion direction and having a longitudinal dimension for aligning with the feed direction, the insertion perimeter being formed by a plurality of sides extending between a top surface and a bottom surface of the ink stick body;

a symbol contour formed in a first position on at least one side of the insertion perimeter of the ink stick body extending at least partially along the ink stick body in a direction substantially parallel to the insertion direction, the symbol contour defining a portion of a perimeter of a visually recognizable symbol shape, the symbol contour occupying only a portion of the at least one side of the insertion perimeter of the ink stick to enable a remaining portion of the at least one side that also forms a portion of the insertion perimeter to be formed with features that do not form a portion of the visually recognizable symbol shape.

2. The ink stick of claim 1, the visually recognizable symbol shape comprising an alphanumeric character.

3. The ink stick of claim 2 wherein the symbol contour is formed in opposing lateral perimeter segments with a first portion of the visually recognizable symbol contour being formed in a first lateral perimeter segment and with a second portion of the visually recognizable symbol contour being formed in an opposing lateral perimeter segment, the first and the second portions of the visually recognizable symbol contour occupying only a portion of the insertion perimeter in the first perimeter segment and the opposing perimeter segment to enable a remaining portion of the first perimeter segment and a remaining portion of the opposing perimeter segment to be formed with features that do not form a portion of the visually recognizable symbol shape.

4. The ink stick of claim 2, a top surface of the ink stick body being embossed with a remaining portion of the visually recognizable symbol shape.

5. The ink stick of claim 2, a top surface of the ink stick body being debossed with a remaining portion of the visually recognizable symbol shape.

6. The ink stick of claim 2, further comprising:

at least one non-symbolic key contour formed in a second position on the at least one side of the insertion perimeter of the ink stick body.

7. A set of ink sticks for use with a phase change ink imaging device, the set of ink sticks comprising:

a first, second, third and fourth ink stick each having a top surface, a bottom surface, and a plurality of side surfaces extending between the top and the bottom surfaces, the plurality of side surfaces defining a perimeter of the ink stick body, the perimeter including a leading perimeter segment, a trailing perimeter segment, and a pair of lateral perimeter segments extending between the leading and trailing perimeter segments, each of the first, second, third and fourth ink sticks having a longitudinal axis extending between the leading and the trailing perimeter segments for aligning with a feed direction of an ink loader of a phase change ink imaging device;

each of the first, second, third and fourth ink sticks including a symbol contour formed in a symbol position on at least one of the lateral perimeter segments, the symbol contour defining a portion of a perimeter of a visually recognizable symbol shape as viewed in a direction substantially toward the top surface of the ink stick body, the symbol contour extending from the top surface at least partially toward the bottom surface of the ink stick body and extending at most along a portion of the at least one of the lateral perimeter segments in a direction parallel to the longitudinal axis of the ink stick to enable a remaining portion of the at least one of the lateral perimeter segments that also forms a portion of the insertion perimeter to be formed with features that do not form a portion of the visually recognizable symbol shape; and the first ink stick being of a first color and having a first symbol contour defining a portion of a perimeter of a first visually recognizable symbol shape, the second ink stick being of a second color having a second symbol contour defining a portion of a perimeter of a second visually recognizable symbol shape, the third ink stick being of a third color having a third symbol contour defining a portion of a perimeter of a third visually recognizable symbol shape, and the fourth ink stick being of a fourth color having a fourth symbol contour defining a portion of a perimeter of a fourth visually recognizable symbol shape.

8. The set of ink sticks of claim 7, the first, second, third and fourth visually recognizable symbol shapes each comprising an alphanumeric character.

9. The set of ink sticks of claim 8, the first, second, third and fourth visually recognizable symbol shapes comprising consecutive numerals.

10. The set of ink sticks of claim 8, the first, second, third and fourth visually recognizable symbol shapes each comprising a shape of a letter that indicates the first, second, third and fourth colors, respectively.

11. The set of ink sticks of claim 8, each of the first, second, third and fourth visually recognizable symbol shapes corresponding to an insertion opening of the ink loader for the first, second, third and fourth ink sticks, respectively.

12. The set of ink sticks of claim 8, the top surface of the each of the first, second, third and fourth ink sticks being embossed with a remaining portion of the perimeter of the first, second, third and fourth visually recognizable symbol shapes, respectively.

13. The set of ink sticks of claim 8, the top surface of the each of the first, second, third and fourth ink sticks being debossed with a remaining portion of the perimeter of the first, second, third and fourth visually recognizable symbol shapes, respectively.

14. The set of ink sticks of claim 8, each of the first, second, third and fourth ink sticks including at least one non-symbolic key contour corresponding to the color of the ink stick, the at least one non-symbolic key contour being formed on the perimeter of each ink stick extending from the top surface at least partially toward the bottom surface, a position of the at least one non-symbolic key contour on the perimeter being different for each of the first, second, third and fourth ink sticks and being different from the symbol position.

15. An ink stick for use in a phase change ink imaging device, the ink stick comprising:

an ink stick body including a top surface, a bottom surface and a plurality of side surfaces extending between the top and the bottom surfaces, the plurality of side surfaces defining a perimeter of the ink stick body, the perimeter including a leading perimeter segment, a trailing perimeter segment, and a pair of lateral perimeter segments extending between the leading and trailing perimeter segments, the ink stick body having a longitudinal axis extending between the leading and the trailing perimeter segments for aligning with a feed direction of an ink loader of a phase change ink imaging device;

a symbol contour formed in at least one of the pair of lateral perimeter segments in a first position on the perimeter, the symbol contour defining a portion of a perimeter of a visually recognizable symbol shape as viewed in a direction substantially toward the top surface of the ink stick body, the symbol contour extending from the top surface at least partially toward the bottom surface of the ink stick body and extending at most along only a portion of the at least one lateral perimeter segment to enable a remaining portion of the at least one lateral perimeter segment that also forms a portion of the insertion perimeter to be formed with features that do not form a portion of the visually recognizable symbol shape; and at least one key contour formed in the remaining portion of the at least one lateral perimeter segment.

16. The ink stick of claim 15, the visually recognizable symbol comprising an alphanumeric character.

17. The ink stick of claim 16, the visually recognizable symbol corresponding to a visually recognizable symbol incorporated into the phase change ink imaging device.

18. The ink stick of claim 16, the top surface of the ink stick body at the first position being embossed with a remaining portion of the perimeter of the visually recognizable symbol shape.

19. The ink stick of claim 16, the top surface of the ink stick body at the first position being debossed with a remaining portion of the perimeter of the visually recognizable symbol shape.

* * * * *